US006147035A

United States Patent [19]

Sougawa et al.

[11] Patent Number: 6,147,035

[45] **Date of Patent: *Nov. 14, 2000**

[54] LUBRICATING OIL COMPOSITION CONTAINING OVERBASED METAL SALICYLATE, AMINE ANTIOXIDANT, PHENOL ANTIOXIDANT, POLYALKENYLSUCCINIMIDE AND ZINC DIALKYLDITHIOPHOSPHATE

[75] Inventors: Yasunori Sougawa, Ohi-Machi; Masakichi Shimada, Wako; Masaaki Shiomi, Ohi-Machi, all of Japan

[73] Assignee: Tonen Corporation, Saitama, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/004,882

[22] Filed: Jan. 9, 1998

[30] Foreign Application Priority Data

Feb. 3, 1997 [JP] Japan ..... 9-034317

[51] Int. Cl.[7] ..... C10M 141/12; C10M 159/22

[52] U.S. Cl. ..... 508/192; 508/291; 508/294; 508/371; 508/375; 508/460

[58] Field of Search ..... 508/192, 291, 508/294, 371, 375, 460

[56] References Cited

U.S. PATENT DOCUMENTS

| | | | |
|---|---|---|---|
| 4,769,178 | 9/1988 | Kenmochi et al. | 508/493 |
| 4,867,890 | 9/1989 | Colclough et al. | 508/192 |
| 5,525,247 | 6/1996 | Miyaji et al. | 508/192 |
| 5,672,570 | 9/1997 | Miyaji et al. | 508/192 |
| 5,726,133 | 3/1998 | Blahey et al. | 508/398 |
| 5,792,835 | 8/1998 | Cook et al. | 508/398 |

FOREIGN PATENT DOCUMENTS

| | | | |
|---|---|---|---|
| 0562172 | 9/1993 | European Pat. Off. | C10M 141/08 |
| 0663436 | 7/1995 | European Pat. Off. | C10M 133/56 |
| 0686689 | 12/1995 | European Pat. Off. | C10M 141/10 |
| 0725129 | 8/1996 | European Pat. Off. | C10M 163/00 |

*Primary Examiner*—Jerry D. Johnson
*Attorney, Agent, or Firm*—Joseph J. Allocea

[57] ABSTRACT

A lubricating oil composition is provided, which comprises a lubricating base oil and based on the whole weight of the lubricating oil composition, (A) 0.5 wt % to 10 wt % of a metal salicylate having a total base number of from 100 mg-KOH/g to 195 mg-KOH/g, (B) 0.1 wt % to 10 wt % of a diarylamine compound, (C) 0.1 wt % to 10 wt % of a hindered phenol compound, and (D) 1 wt % to 10 wt % of a polyalkenylsuccinimide and/or a boron-containing polyalkenylsuccinimide. Also provided is a lubricating oil composition which further comprises 0.1 wt % to 10 wt % of a metal phenate having a total base number of from 100 mg-KOH/g to 300 mg-KOH/g as a component (E) in addition to the above components (A) to (D). The lubricating oil composition is excellent in all properties of detergency, $NO_x$ oxidation resistance and thermal oxidation resistance and suitable as a long-life engine oil for gas engine heat pumps.

8 Claims, No Drawings

LUBRICATING OIL COMPOSITION CONTAINING OVERBASED METAL SALICYLATE, AMINE ANTIOXIDANT, PHENOL ANTIOXIDANT, POLYALKENYLSUCCINIMIDE AND ZINC DIALKYLDITHIOPHOSPHATE

BACKGROUND OF THE INVENTION

1. Field of the Invention

This invention relates to a lubricating oil composition, and specifically to a lubricating oil composition which is excellent in detergency, $NO_x$ oxidation resistance and thermal oxidation resistance and is suitable as a long-life engine oil for gas engine heat pumps.

2. Prior Art

Concerning gas engine heat pumps (hereinafter abbreviated as "GHP"), research and development work have been started in recent years as a part of the gas-powered air-conditioning popularization promoting policy. This research and development work has already led to commercialization of gas engine heat pump air conditioners and the like. As the popularization of these apparatuses has proceeded further, an increasing need has, however, arisen for their maintenance and inspection work. This has led to an important theme, that is, a need for improvements in maintenance such as simplification of an inspection and prolongation of maintenance work intervals. In particular, prolongation of a drain interval of an engine oil has become the key to improvements in maintenance.

On the other hand, a GHP engine oil is accompanied by the problem that it is prone to extremely premature deterioration upon contact with $NO_x$ contained at a high concentration in blowby gas because of the structure of a GHP apparatus and a high combustion temperature. As quality requirements for the GHP engine oil, the following properties are therefore required especially:

(1) excellent anti-$NO_x$ performance, (2) excellent thermal oxidation resistance, and (3) dispersibility of residues in oil.

Nonetheless, GHP engine oils which have been proposed to date cannot meet all of the above-mentioned quality requirements, but are still insufficient not only in $NO_x$ oxidation resistance but also in thermal oxidation resistance. They are also prone to form sludge and deposits due to $NO_x$ deterioration. $NO_x$ deterioration is estimated to take place in such a way that $NO_x$ would attack a base oil and additives in an engine oil to form highly reactive radicals and deterioration would then proceed due to $NO_x$, oxygen and heat. The sludge so formed contains reaction products of the base oil and $NO_x$ ($RONO_2$, R: hydrocarbon groups), reaction products of the additives and $NO_x$, oxidation-deteriorated products of the base oil (RCOOH, R: hydrocarbon groups), and engine oil components. Their presence brings about an increase in viscosity, an increase in acid number and the like for the engine oil, whereby lubricating performance is significantly impaired. For a GHP oil susceptible to such influence, a high degree of detergency is hence required.

With the foregoing circumstances in view, the present invention therefore has as an object thereof the provision of a lubricating oil composition which is excellent in all the properties of detergency, $NO_x$ oxidation resistance and thermal oxidation resistance and is suitable as a long-life GHP engine oil.

SUMMARY OF THE INVENTION

It has been found that use of a metal salicylate having a specific total base number, a particular amine compound, a hindered phenol compound, and a polyalkenylsuccinimide and/or a boron-containing polyalkenylsuccinimide as essential components in a specific combination and in particular proportions makes it possible to obtain a lubricating oil composition, especially a GHP engine oil which is excellent in all the properties of detergency, $NO_x$ oxidation resistance and thermal oxidation resistance and has achieved a long service life. This finding has then led to the completion of the present invention.

The present invention relates to a lubricating oil composition characterized in that the composition comprises a lubricating base oil and based on the whole weight of the lubricating oil composition:

(A) 0.5 wt % to 10 wt % of a metal salicylate having a total base number (TBN) of from 100 mg-KOH/g to 195 mg-KOH/g;

(B) 0.1 wt % to 10 wt % of at least one oxidation inhibitor selected from the group consisting of amine compounds;

(C) 0.1 wt % to 10 wt % of at least one oxidation inhibitor selected from the group consisting of hindered phenol compounds; and (D) 1 wt % to 10 wt % of a polyalkenylsuccinimide and/or a boron-containing polyalkenylsuccinimide.

Further, the present invention also relates to a lubricating oil composition characterized in that in addition to the above components (A) to (D), the lubricating oil composition further comprises, as a component (E), 0.1 wt % to 10 wt % of a metal phenate have a total base number of from 100 mg-KOH/g to 300 mg-KOH/g.

According to the present invention, there is also provided a lubricating oil composition comprising the above components (A) to (D) or the above components (A) to (E), in which the total base number of the lubricating oil composition is from 1 mg-KOH/g to 20 mg-KOH/g.

Preferred embodiments of the present invention include:

(i) a lubricating oil composition comprising a lubricating base oil and based on the whole weight of the lubricating oil composition, (A) 0.5 wt % to 10 wt % of a metal salicylate having a total base number of from 100 mg-KOH/g to 195 mg-KOH/g;

(B) 0.1 wt % to 10 wt % of at least one oxidation inhibitor selected from the group consisting of amine compounds represented by:

Formula (I)

(I)

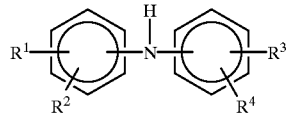

Formula (II)

(II)

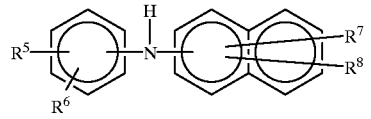

Formula (III)

(III)

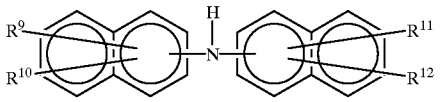

wherein in the above formulas (I), (II) and (III), $R^1$ to $R^{12}$ are each a hydrogen atom or a hydrocarbon atom having 1–18 carbon atoms and may be either the same or different, and Formula (IV)

(IV)

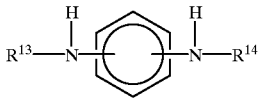

wherein in the above formula (IV), $R^{13}$ and $R^{14}$ are each a hydrocarbon group having 1–18 carbon atoms and may be either the same or different;

(C) 0.1 wt % to 10 wt % of at least one oxidation inhibitor selected from the group consisting of phenol compounds represented by:

Formula (V)

(V)

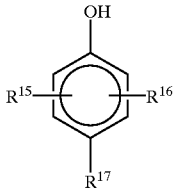

wherein in the above formula (V), $R^{15}$ to $R^{17}$ may be the same or different and are each a hydrogen atom, a hydroxyl group or a hydrocarbon group having 1–40 carbon atoms; and the hydrocarbon group is linear, branched, cyclic or aromatic, may contain one or more double bond and may contain in a structure thereof at least one group or atom selected from the group consisting of:

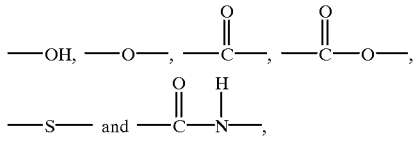

Formula (VI)

(VI)

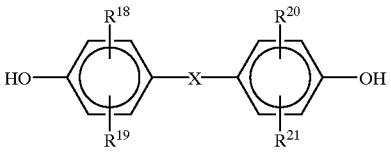

wherein in the above formula (VI), $R^{18}$ to $R^{21}$ may be the same or different and are each a hydrogen atom, a hydroxyl group or a hydrocarbon group having 1–40 carbon atoms; and the hydrocarbon group is linear, branched, cyclic or aromatic, may contain one or more double bond and may contain in a structure thereof at least one group or atom selected from the group consisting of:

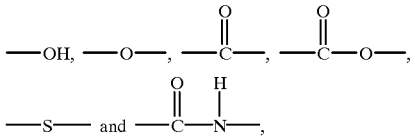

X is —S— or a hydrocarbon group having 1–45 carbon atoms; and the hydrocarbon group is linear, branched, cyclic or aromatic, may contain one or more double bond and may contain in a structure thereof at least one group or atom selected from the group consisting of:

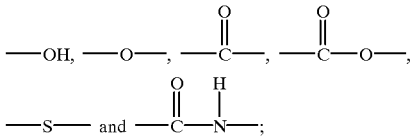

(D) 1 wt % to 10 wt % of a polyalkenylsuccinimide or a boron-containing polyalkenylsuccinimide; and the total base number of the lubricating oil composition is from 1 mg-KOH/g to 20 mg-KOH/g;

and, optionally (E) 0.1 wt % 4 to 10 wt % of a metal phenate having a total base number of 100 mg-KOH/g to 300 mg-KOH/g; and the total base number of the lubricating oil composition is from 1 mg-KOH/g to 20 mg/KOH/g.

(ii) More preferably, the lubricating oil composition comprises a mineral base oil and/or a synthetic base oil and based on the whole weight of the lubricating oil composition:

(A) 0.5 wt % to 10 wt % of an alkaline earth metal salicylate having a total base number of from 100 mg-KOH/g to 195 mg-KOH/g;

(B) 0.1 wt % to 10 wt % of an oxidation inhibitor composed of a dialkyldiphenylamine and a phenyl-α-naphthylamine;

(C) 0.1 wt % to 10 wt % of an oxidation inhibitor composed of 2,2-thio[diethyl bis-3(3,5-di-t-butyl-4-hydroxyphenol)propionate] and 4,4'-methylenebis (2,6-di-t-butylphenol); and (D) 1 wt % to 10 wt % of a boron-containing polyalkenylsuccinimide.

(iii) Another preferred embodiment comprises a lubricating oil composition comprising a mineral base oil and/or a synthetic base oil and based on the whole weight of the lubricating oil composition:

(A) 0.5 wt % to 10 wt % of an alkaline earth metal salicylate having a total base number of from 100 mg-KOH/g to 195 mg-KOH/g;

(B) 0.1 wt % to 10 wt % of an oxidation inhibitor composed of a dialkyldiphenylamine and a phenyl-α-naphthylamine;

(C) 0.1 wt % to 10 wt % of an oxidation inhibitor composed of 2,2-thio[diethyl bis-3(3,5-di-t-butyl-4-hydroxyphenol)propionate] and 4,4'-methylenebis (2,6-di-t-butylphenol);

(D) 1 wt % to 10 wt % of a boron-containing polyalkenylsuccinimide; and (E) 0.1 wt % to 10 wt % of a metal phenate having a total base number of from 100 mg-KOH/g to 300 mg-KOH/g; and the total base number of the lubricating oil composition is from 1 mg-KOH/g to 20 mg-KOH/g.

The present invention will hereinafter be described in detail.

No particular limitation is imposed on the lubricating base oil for use in the lubricating oil composition according to the present invention, and one commonly employed to date as a base oil for lubricating oils, for example, a mineral base oil, a synthetic base oil or the like can be used. Illustrative of the mineral base oil can be mineral oils available from lubricating oil refining steps of raw materials for lubricating oils, such as solvent refining making use of phenol, furfural, N-methylpyrrolidone or the like, hydro-refining and wax isomerization; for example, light neutral oil, medium neutral oil, heavy neutral oil, bright stock and the like. Illustrative of the synthetic base oil, on the other hand, can be poly-α-olefin oligomers, polybutene, alkylbenzene, polyol esters, polyglycol esters, dibasic acid esters and the like. These base oils may be used either singly or in combination. Further, one or more mineral base oils and one or more synthetic base oils may be used as a mixture.

As the base oil for use in the lubricating oil composition according to the present invention, one having a kinematic viscosity at 100° C. in a range of from 3.5 $mm^2/s$ to 20 $mm^2/s$, preferably from 4 $mm^2/s$ to 15 $mm^2/s$ is usable. As a base oil for a GHP lubricating oil, in particular, one having a kinematic viscosity at 100° C. in a range of from 3.5 $mm^2/s$ to 10.0 $mm^2/s$, preferably from 4.5 $mm^2/s$ to 8 $mm^2/s$ is preferred. Kinematic viscosities lower than the above range tend to develop seizure, while kinematic viscosities higher than the above range adversely affect startability at low temperatures and a reduction of fuel consumption. Kinematic viscosities outside the above range are therefore not preferred.

Use of a hydro-refined oil as a mineral base oil is particularly preferred for the attainment of the object of the present invention. This hydro-refined oil generally has a saturated hydrocarbon content of 90 wt % or higher, an aromatic hydrocarbon content of 2 wt % or lower, a polar compound content of 0.5 wt % or lower and a bromine number of 1 or less. The composition of hydro-carbons can be determined by a carbon type analyzing method which makes use of gel chromatography. Further, a bromine number can be measured using the method of JIS K2605. Such a hydro-refined oil exhibits marked advantageous effects in $NO_x$ oxidation resistance compared with solvent-refined oils which have saturated hydrocarbon contents of 80 wt % or lower and aromatic hydro-carbon contents of 10 wt % or higher.

Examples of the metal salicylate used as the component (A) in the lubricating oil composition according to the present invention can include compounds represented by the following formula (VII):

(VII)

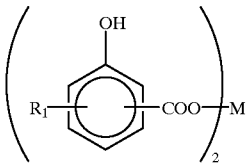

As an alternative, a salicylate sulfide can also be used. Examples of the salicylate sulfide can include compounds represented by the following Formula (VIII):

(VIII)

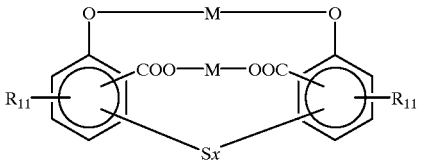

In the above formulas (VII) and (VIII), $R_1$, $R_{11}$, and $R_{111}$, are the same or different hydrocarbon groups having 1–30 carbon atoms, preferably 6–18 carbon atoms. Illustrative of the hydrocarbon groups can be alkyl groups having 1–30 carbon atoms, alkenyl groups having 2–30 carbon atoms, cycloalkyl groups having 3–30 carbon atoms, aryl groups having 6–30 carbon atoms, and the like. Linear or branched alkyl groups having 4–20 carbon atoms are particularly preferred. On the other hand, x stands for an integer of 1 to 5.

The metal salicylate employed in the lubricating oil composition according to the present invention is such a metal salicylate that its total base number has been controlled to 100 mg-KOH/g to 195 mg-KOH/g. In particular, one having a total base number of 190 mg-KOH/g or smaller is preferred. A metal salicylate having a total base number outside the above range causes problems such that a metal salicylate with a TBN smaller than 100 mg-KOH/g leads to insufficient detergency and $NO_x$ oxidation resistance while a metal salicylate with a TBN greater than 195 mg-KOH/g leads to more ash in a lubricating oil and results in more deposits in a combustion chamber.

The basicity of the metal salicylate is impaired by dispersing a metal hydroxide or carbonate in a compound such as that represented by the above-described formula (VII) or (VIII). In the present invention, it is possible to use one produced, for example, by subjecting a neutral salt of a metal salicylate to carbon dioxide treatment or the like so that its total base number falls within the above-described range. As an alternative, a metal salicylate having the above-described specific total base number can also be obtained by mixing a neutral salt and an ultrabasic salt at a desired ratio.

Usable examples of the metal salicylate can include alkaline earth metal salicylates, for example, the magnesium salt, the calcium salt, the barium salt and the like, with the calcium salt being particularly preferred.

In the lubricating oil composition according to the present invention, the proportion of the metal salicylate as the component (A) is in a range of from 0.5 wt % to 10 wt %, preferably from 1 wt % to 8 wt % based on the whole weight of the lubricating oil composition. Proportions lower than 0.5 wt % cannot fully exhibit improving effects for $NO_x$ oxidation resistance. From proportions higher than 15 wt %, on the other hand, no improvements can be observed to such extents as corresponding to the increased proportions.

As the component (B), i.e., the amine compound in the lubricating oil composition according to the present invention, it is possible to use, for example, at least one compound selected from the group of compounds represented by:

Formula (I)

(I)

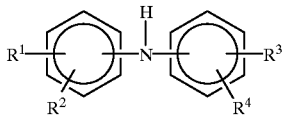

Formula (II)

(II)

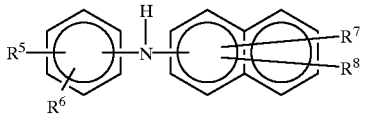

Formula (III)

(III)

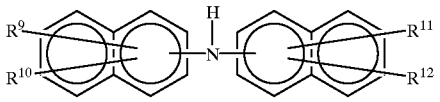

Formula (IV)

(IV)

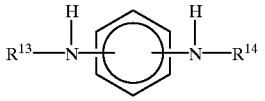

In the above-described formulas (I), (II) and (III), $R^1$ to $R^{12}$ are the same or different and are each a hydrogen atom or a hydrocarbon group having 1–18 carbon atoms. Examples of the hydrocarbon group can include alkyl groups having 1–18 carbon atoms, alkenyl groups having 2–18 carbon atoms, cycloalkyl groups having 3–18 carbon atoms, aryl groups having 6–18 carbon atoms, alkylaryl groups and the like, with alkyl groups being particularly preferred. The alkyl groups and alkenyl groups may be either linear or branched.

In the formula (IV), $R^{13}$ and $R^{14}$ are the same or different and are each a hydrogen atom, a hydroxyl group or a hydrocarbon group having 1–18 carbon atoms. Examples of the hydrocarbon group can include alkyl groups having 1–18 carbon atoms, alkenyl groups having 2–18 carbon atoms, cycloalkyl groups having 3–18 carbon atoms , and aryl groups having 6–18 carbon atoms, for example, a phenyl group, a naphthyl group and the like. The alkyl groups and alkenyl groups may be either linear or branched.

Specific examples of the amine compound can include monooctyldiphenylamine, monononyldipheylamine, p,p'-dibutyldiphenylamine, p,p'-dipentyldiphenylamine, p,p'-dihexyldiphenylamine, p,p'-diheptyldiphenylamine, p,p'-dioctyldiphenylamine, p,p'-dinonyldiphenylamine, tetrabutyldipheylamine, tetrahexyldiphenylamine, tetraoctyldiphenylamine, tetranonyldiphenylamine, alkylated diphenylamines containing as substituents 1 to 4 alkyl groups having 4–18 carbon atoms, α-naphtylamine, phenyl-α-naphthylamine, phenyl-β-naphthylamine, butylphenyl-α-naphthylamine, butylphenyl-β-naphthylamine, pentylphenyl-α-naphthylamine, pentylphenyl-β-naphthyl amine, hexylphenyl-α-naphthylamine, hexylphenyl-β-naphthylamine, heptylphenyl-α-naphthylamine, heptylphenyl-β-naphthylamine, octylphenyl-α-naphthylamine, octylphenyl-β-naphthylamine, nonylphenyl-α-naphthylamine, nonylphenyl-β-naphthylamine, dinaphtylamine, 6-ethoxy-2,2,4-trimethyl-1,2-dihydroxyquinoline, 2,2,4-trimethyl-1,2-dihydroxyquinoline polymers, 4,4'-tetramethyldiaminodiphenylmethane, aldol-α-naphthylamine, and the like.

Among the diarylamine compounds represented by the formula (I), p,p'-dioctyldiphenylamine can be mentioned as a preferred example. Phenyl-α-naphtylamine and alkylphenyl-α-naphthylamines can be mentioned as preferred examples of the diarylamine compounds represented by the formula (II). Further, dinaphthylamine and the like can be mentioned as illustrative diarylamine compounds represented by the formulate (III).

In the lubricating oil composition according to the present invention, the above-described diarylamine compounds represented by the formula (I) can be used either singly or in combination. The above-described diarylamine compounds represented by the formula (II) can be used either singly or in combination, although combined use of two or more of them can improve the thermal oxidation resistance further. Further, the above-described diarylamine compounds represented by the formula (III) can also be used either singly or in combination. Combined use of one or more of the diarylamine compounds represented by the formula (I) and one or more of the diarylamine compounds represented by the formula (II) can improve $NO_x$ oxidation resistance and the like further. It is desired to use one or more of the diarylamine compounds represented by the formula (I) and one or more of the diarylamine compounds represented by the formula (II) by mixing them at a weight ratio of from 10:90 to 90:10, preferably from 20:80 to 80:20. A preferred specific example is a combination of p,p'-dioctyldiphenylamine and phenyl-α-naphthylamine at a weight ratio of about 30:70. The diarylamine compounds represented by the formula (III) can be used together with the compounds represented by the formulas (I) and (II) or instead of the compounds represented by the formulas (I) and (II).

In the lubricating oil composition according to the present invention, the proportion of the amine compound as the component (B) is in a range of from 0.1 wt % to 10 wt %, preferably from 0.3 wt % to 3 wt % based on the whole weight of the lubricating oil composition. Proportions lower than 0.1 wt % cannot fully exhibit improving effects for $NO_x$ oxidation resistance. From proportions higher than 10 wt %, on the other hand, no improvements can be observed to such extents as corresponding to the increased proportions.

As the component (C), i.e., the hindered phenol compound, it is possible to use at least one compound selected from the group consisting of hindered phenol compounds represented by:

Formula (V)

(V)

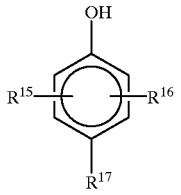

and

Formula (VI)

(VI)

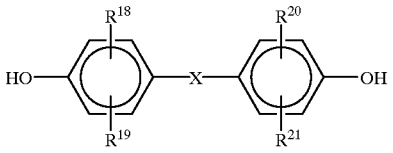

In the above formula (V), $R^{15}$ to $R^{17}$ are the same or different and are each a hydrocarbon group having 1–40 carbon atoms, and the hydrocarbon group is linear, branched, cyclic or aromatic, may contain one or more double bond and may contain in the structure thereof:

at least one group or atom selected from the group consisting of:

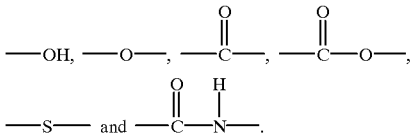

Exemplary examples of the hydrocarbon group can include alkyl groups having 1–40 carbon atoms, alkenyl groups having 2–40 carbon atoms, cycloalkyl groups having 3–40 carbon atoms, aryl groups having 6–40 carbon atoms, alkylaryl groups having 7–40 carbon atoms, arylalkyl groups having 7–40 carbon atoms, and the like.

As specific compounds represented by the formula (V), 2,6-di-t-butyl-p-cresol, 2,6-di-t-butyl-4-ethyl-phenol, 2,4-dimethyl-6-t-butylphenol and the like can be exemplified. As a particularly preferred compound, 2,6-di-t-butyl-p-cresol can be mentioned.

The compound represented by the formula (VI) also belongs to hindered phenol compounds. In the formula, $R^{18}$ to $R^{21}$ are each a hydrogen atom, a hydroxyl group or a hydrocarbon group having 1–18 carbon atoms. The hydrocarbon group may be linear, branched, cyclic or aromatic, and may contain one or more double bond. Further, the hydrocarbon group may contain in a structure thereof:

at least one group or atom selected from the group consisting of:

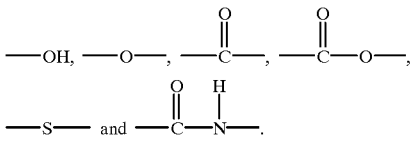

In the formula, X is —S— or a hydrocarbon group having 1–45 carbon atoms, and the hydrocarbon group may be linear, branched, cyclic or aromatic and may contain one or more double bond. Further, the hydrocarbon group may contain in the structure thereof:

at least one group or atom selected from the group consisting of:

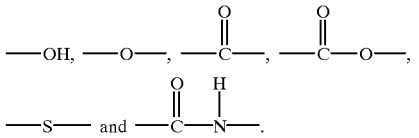

Specific examples of the compound represented by the formula (VI) can include 4,4'-methylenebis(2,6-di-t-butylphenol), 4,4'-isopropylidenebis(2,6-di-t-butyphenol), 4,4'-butylidenebis(4-methyl-6-t-butylphenol), 4,4'-thiobis (2-methyl-6-t-butylphenol), 4,4'-thiobis(3-methyl-6-t-butylphenol), 2,2-thio[diethylbis-3(3,5-di-t-butyl-4-hydroxyphenol)propionate], and the like. Particularly preferred can be 4,4'-methylenebis(2,6-di-t-butylphenol), 4,4'-methylenebis(6-t-butyl-o-cresol) and 2,2-thio [diethylbis-3(3,5-di-t-butyl-4-hydroxyphenol)propionate].

In the lubricating oil composition according to the present invention, the hindered phenol compounds represented by the formula (V) may be used either singly or in combination, and the hindered phenol compounds represented by the formula (VI) may also be used either singly or in combination. Further, one or more of the hindered phenol compounds represented by the formula (V) and one or more of the hindered phenol compounds represented by the formula (VI) may be used in combination.

In the lubricating oil composition according to the present invention, the proportion of the oxidation inhibitor composed of the hindered phenol compound is in a range of from 0.1 wt % to 10 wt %, preferably from 0.3 wt % to 4 wt % based on the whole weight of the lubricating oil composition. Proportions lower than 0.1 wt % cannot fully exhibit improving effects for $NO_x$ oxidation resistance. From proportions higher than 10 wt %, on the other hand, no improvements can be observed to such extents as corresponding to the increased proportions.

In the above oxidation inhibitor, the ratio of the amine compound to the hindered phenol compound may be in a range of from 9:1 to 1:9, preferably form 7:3 to 3:7.

As the component (D), i.e., the ashless dispersing agent in the lubricating oil composition according to the present invention, a polyalkenylsuccinimide and/or a boron-containing polyalkenylsuccinimide is used.

Usable examples of the above-described polyalkenylsuccinimide include monopolyalkenylsuccinimides represented by the following formula (IX):

(IX)

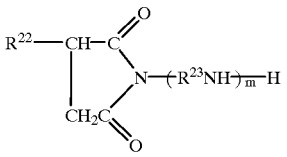

In the above formula (IX), $R^{22}$ is an olefin oligomer residual group having 30 or more carbon atoms, $R^{23}$ is an alkylene group having 2–4 carbon atoms, and m is an integer of 1 to 10.

Further, bispolyalkenylsuccinimides represented by the following formula (X):

(X)

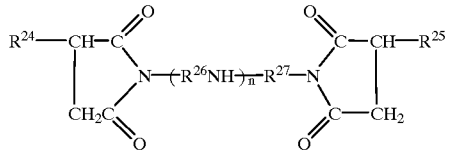

can be mentioned.

In the formula (X), $R^{24}$ and $R^{25}$ are each an olefin oligomer residual group having 30 or more carbon atoms and may be the same or different, and $R^{26}$ and $R^{27}$ are each an alkylene group having 2–4 carbon atoms and may be the same or different. Further, n stands for 0 or an integer of 1 to 10.

In the lubricating oil composition according to the present invention, it is preferred to use as the polyalkenylsuccinimide a bis-form compound as a primary component.

These polyalkenylsuccinimides can each be produced generally by reacting a polyalkenylsuccinic anhydride, which is available form a reaction between a polyolefin and maleic anhydride, with a polyalkylene polyamine. By changing the ratio of the polyalkenyl succinic anhydride to the polyalkylene polyamine upon conducting the above reaction, a monopolyalkkenylsuccinimide or a bispolyalkenylsuccinimide or a mixture thereof can be obtained.

The polyolefin, which is employed as a raw material in the production of the polyalkenylsuccinimide, may preferably be one available by polymerization of an olefin, which has 2–6 carbon atoms, and having 30 or more, preferably 40 or more carbon atoms and an average molecular weight of from 500 to 20,000, preferably from 700 to 5,000. Preferred examples of the olefin for the production of the polyolefin can include α-olefins having 2–8 carbon atoms, such as ethylene, propylene, 1-butene, isobutylene, 1-hexene, 2-methylpentene-1 and 1-octene. Particularly preferred polyolefins are polyisobutylene.

On the other hand, usable examples of the polyalkylenepolyamine can include compounds represented by the following formula (XI):

(XI)

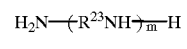

$R^{23}$ and m in the above formula (XI) have the same meanings as defined above in connection with the formula (IX).

Further, usable examples of the polyalkylenepolyamine can also include compounds represented by the following formula (XII):

(XII)

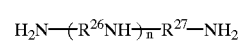

$R^{26}$, $R^{27}$ and n in the above formula have the same meanings as defined above in connection with the formula (X).

Illustrative of such polyalkylenepolyamines are polyethylenepolyamine, polypropylenepolyamine, polybutylenepolyamine and the like. Of these, polyethylenepolyamine is suited.

Further, it is preferred to use, as the component (D), a boron-containing polyalkenylsuccinimie which is obtained by reacting a boron compound with the above polyalkenylsuccinimide. In particular, a boron-containing bispolyalkenylsuccinimide is effective.

In the lubricating oil composition according to the present invention, the proportion of the polyalkenylsuccinimide and/or the boron-containing polyalkenylsuccinimide as the component (D) is in a range of form 1 wt % to 10 wt %, preferably from 4 wt % to 8 wt % based on the whole weight of the lubricating oil composition. Proportions lower than 1 wt % result in inferior detergency and $NO_x$ oxidation resistance, thereby failing to achieve the object of the present invention. From proportions higher than 10 wt %, on the other hand, no improvements can be observed to such extents as corresponding to the increased proportions.

In the lubricating oil composition according to the present invention, a metal phenate can also be used as a component (E) for the lubricating base oil in addition to the above-described components: (A) the metal salicylate, (B) the oxidation inhibitor composed of the amine compound, (C) the oxidation inhibitor composed of the hindered phenol compound, and (D) the polyalkenylsuccinimide and/or the boron-containing polyalkenylsuccinimide. The metal phenate is a metal salt of an alkylphenol sulfide. Usable examples are alkaline earth metal salts such as the calcium salt and the barium salt. One having a total base number of from 100 mg-KOH/g to 300 mg-KOH/g is preferred. A more preferred metal phenate is one having a total base number of from 200 mg-KOH/g to 280 mg-KOH/g.

The proportion of the component (E) is in a range of from 0.1 wt % to 10 wt %, with 0.3 wt % to 5 wt % being preferred, based on the whole weight of the lubricating oil composition.

The additional incorporation of the component (E) in the above-described lubricating oil composition, which comprises the component (A) to the component (D), makes it possible to further improve the detergency, $NO_x$ oxidation resistance and thermal oxidation resistance.

It is preferred for the improvements of the detergency, $NO_x$ oxidation resistance and thermal oxidation resistance that the total base number of the lubricating oil composition, which comprises the lubricating base oil and the additives (including those to be described below) and obtained as described above, falls within the range of from 1 mg-KOH/g to 20 mg-KOH/g. It is important to control the individual components accordingly. Total base numbers smaller than 1 mg-KOH/g may lead to insufficient detergency and $NO_x$ oxidation resistance. On the other hand, total base numbers greater than 20 mg-KOH/g may not bring about these effects to such extents as corresponding to the increases and moreover, may develop a problem of an increase in deposits due to an increased ash content.

To the lubricating oil composition according to the present invention, it is possible to add various lubricating oil additives commonly used to date—for example, other metallic detergents, friction modifiers, wear inhibitors, viscosity index improvers, pour-point depressants, rust inhibitors, corrosion inhibitors, foam inhibitors, other radial-scavenging oxidation inhibitors, peroxide-decomposing oxidation inhibitors and the like—as needed to extents not impairing the object of the present invention.

The other metallic detergents can include, for example, calcium sulfonate, magnesium sulfonate, barium sulfonate, calcium phosphonate, magnesium phosphonate, and the like. They may be used generally in a proportion of from 0.1 wt % to 5 wt %. The friction modifiers can include, for example, molybdenum-base, amine-base, phosphate-ester-base ones. They may be used generally in a proportion of from 0.05 wt % to 5 wt %. The wear inhibitors can include, for example, metal (Zn, Sb, Mo, etc.) salts of dialkyldithiophosphoric acids, especially zinc dithiophosphate; metal (Zn, etc.) salts of dithiocarbamic acids; sulfur compounds; phosphate esters; phosphite esters; amine salts of phosphate esters; amine salts of phosphite esters; and the like. They may be used generally in a proportion of from 0.05 wt % to 5 wt %. Further, the viscosity index improvers can include, for example, polymethacrylate-base, polyisobutylene-base, ethylene-propylene-copolymer-base, and hydrogenated-styrene-butadiene-copolymer-base ones. They may be used generally in a proportion of from 0.5 wt % to 35 wt %. The pour-point a depressants can include, for example, polymethacrylates and the like. The rust inhibitors can include, for example, alkenylsuccinic acids, partial esters thereof and the like. The corrosion inhibitors can include, for example, benzotriazole, benzoimidazole and the like. The foam inhibitors can include, for example, dimethylpolysiloxane, polyacrylates and the like. These additives may be added as much as needed. Illustrative other inhibitors can include thioester-base oxidation inhibitors such as diallyl thiodipropionate, phosphorus-containing oxidation inhibitors such as triphenyl phosphite and triisooctyl phosphite, and sulfur-containing dilauryl thiodipropionate, metabis (phenylmercapto)benzene and dibenzyl disulfide.

As a particularly preferred embodiment of the lubricating oil composition according to the present invention, the following embodiment can be exemplified.

The present invention can provide a lubricating oil composition for gas engine heat pumps, which comprises a hydro-refined oil having a kinematic viscosity of from 4 $mm^2/s$ to 8 $mm^2/s$ at 100° C. as a lubricating base oil and based on the whole weight of the lubricating oil composition, (A) 1 wt % to 8 wt % of an alkaline earth metal salicylate having a total base number of from 150 mg-KOH/g to 190 mg-KOH/g;

(B) 0.5 wt % to 5 wt % of a dialkyldiphenylamine and phenyl-α-naphthylamine;

(C) 0.5 wt % to 5 wt % of 2,2-thio[diethyl bis3(3,5-di-t-butyl-4-hydroxyphenol)propionate] and 4,4'-methylenebis(2,6-di-t-butylphenol);

(D) 2 wt % to 8 wt % of a boron-containing polyalkenylsuccinimide; and (E) 0.3 wt % to 4 wt % of an alkaline earth metal phenate; said lubricating oil composition further comprising a zinc dialkyldithiophosphate (wear inhibitor), an ethylene-propylene copolymer (viscosity index improver), a polymethacrylate (pour-point depressant) and the like, and having a total base number of from 3 mg-KOH/g to 18 mg-KOH/g.

EXAMPLES

The present invention will next be described in further detail by the following examples and comparative examples. It should, however, be borne in mind that the present invention is not limited by these examples and the like.

Incidentally, glass rod lacquer ratings and total acid number increases in oxidation stability tests were measured by the below-described methods.

Further, the total base numbers of salicylates and phenates were determined by the potentiometric titration method ($HClO_4$ method) specified under JIS K2501.

1. Oxidation Stability Test

Following JIS K2514 entitled "Oxidation Stability Testing Method for Lubricating Oils", a testing container, a catalyst, a sample stirring rod and a glass rod are provided. In the testing container with the catalyst placed therein, 250 ml of a sample are collected at room temperature. The test container is then arranged in a constant temperature bath controlled at 165.5±0.5° C. The sample stirring rod is rotated at 1,300±15 rpm. Upon an elapsed time of 24 hours, the testing container is taken out of the constant temperature bath, followed by the detachment of the glass rod and the removal of the catalyst. The sample is then allowed to cool down to room temperature. The following tests are thereafter conducted with respect to the sample before the oxidation test (the unoxidized oil), the oxidized oil and the glass rod.

Increase in Total Acid Number

The total acid numbers of the unoxidized oil and the oxidized oil are measured in accordance with JIS K2501. A difference in total acid number between the samples before and after the oxidation is calculated as an increase in total acid number.

Lacquer Rating

The extent of a lacquer-like substance or sludge adhered on the glass rod is rated in accordance with a lacquer rating standard.

2. $NO_x$ Oxidation Test

In a container, a sample oil is placed in an amount of 150 ml, followed by the addition of iron and copper catalysts. At 150° C. for 12 hours, 1% $NO_2$ gas and air (humidified) are blown into the sample oil at 5 l/hour and 5 l/hour, respectively, whereby a $NO_x$-oxidized test oil is obtained.

The total acid number of the above $NO_x$ oxidation test oil is determined by the potentiometric titration method specified under JIS K2501. An increase in total acid number through the $NO_x$ oxidation test is a value obtained by subtracting the post-test value from the pre-test value. A smaller increase is evaluated to be less $NO_x$ deterioration.

Example 1

A lubricating oil composition was prepared, which contained hydro-refined oil (kinematic viscosity at 100° C.: 5.5 $mm^2/s$) as a base oil, 3.0 wt % of calcium salicylate having a total base number of 190 mg-KOH/g as the component (A), 0.6 wt % of an amine compound (A) (phenyl-α-naphthylamine) and 0.2 wt % of an amine compound B (a dialkyldiphenylamine) as the component (B), 0.6 wt % of a hindered phenol compound A [4,4'-methylenebis(2,6-di-t-butylphenol)] and 0.2 wt % of a hindered phenol compound B [2,2-thio[diethyl bis-3(3,5-di-t-butyl-4-hydroxyphenol) propionate]] as the component (C) and 5.0 wt % of a polyalkenylsuccinimide as the component (D) as well as 1.5 wt % of a zinc dialkyldithiophosphate (wear inhibitor), 0.5 wt % of a dialkylmolybdenum dithiocarbamate (friction modifier), 5.5 wt % of an ethylene-propylene copolymer (viscosity index improver), 0.1 wt % of a polymethacrylate (pour-point depressant), 0.2 wt % of an alkenylsuccinic acid (rust inhibitor), 0.05 wt % of benzotriazole (corrosion inhibitor), and 0.003 wt % of dimethylpolysiloxane (foam inhibitor).

With respect to the lubricating oil composition, an oxidation stability test for internal combustion engine lubricating oils was conducted to determine or measure a glass rod lacquer rating, a total acid number increase, and a total acid number increase after the $NO_x$ oxidation test. Measurement results are shown in Table 1.

Example 2

A lubricating oil composition was prepared of the same composition as that in Example 1 except that a boron-containing bis-type polyalkenylsuccinimide was used instead of the polyalkenylsuccinimide as component (D). The results of the above-described performance evaluation of the lubricating oil composition are shown in Table 1. According to the results, the lubricating oil composition is found to have been somewhat improved in the suppression of an increase of total acid number over the lubricating oil composition of Example 1.

Example 3

A lubricating oil composition was prepared of the same composition as that in Example 2 except that calcium salicylate having a total base number of 110 mg-KOH/g was used instead of the calcium salicylate the total base number of which was 190 mg-KOH/g. Performance evaluation results are shown in Table 1. Compared with Example 2, $NO_x$ oxidation resistance was sufficiently high although somewhat inferior results were obtained in the measurement of the total acid number after the $NO_x$ oxidation test.

Example 4

A lubricating oil composition was prepared by adding 1.0 wt % of calcium phenate having a total base number of 250 mg-KOH/g to the lubricating oil composition of Example 1. Performance evaluation results are shown in Table 1. Compared with Example 2, improved results were obtained in all the tests, that is, in the measurement of a glass rod lacquer rating, the measurement of a total acid number in an oxidation stability test and the measurement of a total acid number after $NO_x$ oxidation.

Example 5

A lubricating oil composition was prepared in the same manner as in Example 2 except that the amine compound A was not added. Performance evaluation results are shown in Table 1.

Example 6

A lubricating oil composition was prepared in exactly the same manner as in Example 2 except that the hindered phenol compound A was not added.

Example 7

A lubricating oil composition was prepared in the same manner as in Example 2 except that the proportion of the calcium salicylate having the total base number of 190 mg-KOH/g was increased from 3.0 wt % to 7.0 wt %. Performance evaluation results are shown in Table 1. The results were comparable with those of Example 2.

Example 8

A lubricating oil composition was prepared in the same manner as in Example 7 except that 1.0 wt % of calcium phenate having a total base number of 250 mg-KOH/g was added further. Performance evaluation results are shown in Table 1. The results were far superior to those of the lubricating oil composition of Example 7.

Example 9

A lubricating oil composition was prepared in exactly the same manner as in Example 8 except that the proportion of the calcium salicylate having the total base number of 190 mg-KOH/g was decreased from 7.0 wt % to 4.0 wt % and the proportion of the calcium phenate of the total base number of 250 mg-KOH/g was increased from 1.0 wt % to 3.0 wt %. Performance evaluation results are shown in Table 1. The results were comparable with those of Example 8.

Comparative Example 1

Prepared was the same lubricating oil composition as that prepared in Example 2 except that the proportion of the boron-containing bis-type polyalkenylsuccinimide was reduced to 0.5 wt %. Performance evaluation results are shown in Table 2. Compared with Example 2, inferior results were obtained in both lacquer rating and total acid number increase.

Comparative Example 2

Prepared was the same lubricating oil composition as that prepared in Example 2 except that neither phenylnaphthylamine nor the dialkyldiphenylamine was added. Performance evaluation results are shown in Table 2. Compared with Example 2, more inferior results were obtained in both lacquer rating and a total acid number increase.

Comparative Example 3

A lubricating oil composition was obtained in exactly the same manner s in Example 2 except that the hindered phenol compounds A and B were both omitted. Performance evaluation results are shown in Table 2. Compared with Example 2, inferior results were obtained in the measurements of both a glass rod lacquer rating and a total acid number increase.

Comparative Example 4

A lubricating oil composition was prepared in exactly the same manner as in Example 2 except that calcium salicylate having a total base number of 70 mg-KOH/g was used instead of the calcium salicylate the total base number of which was 190 mg-KOH/g. Compared with the lubricating oil composition of Example 2, inferior results were obtained in all the measurements of a glass rod lacquer rating, a total acid number after an oxidation stability test and a total acid number after a $NO_x$ oxidation test.

Comparative Examples 5–12

Lubricating oil compositions were each prepared by mixing the components shown in Table 2 in the proportions presented in the same table. As is appreciated from their results, sufficient detergency, $NO_x$ oxidation resistance and thermal oxidation resistance were not obtained when any one of the essential components of the lubricating oil composition according to the present invention was omitted.

From the above examples and comparative examples, it has become clear that marked advantageous effects are exhibited for $NO_x$ oxidation resistance and the like when, as a metal salicylate, one having a medium or low total base number of from 100 mg-KOH/g to 195 mg-KOH/g and having no conventionally-recognized effects for $NO_x$ oxidation resistance is chosen and is combined with amine compound, hindered phenol compound and polyalkenylsuccinimide compound.

TABLE 1

| | | Examples | | | | | | | | |
|---|---|---|---|---|---|---|---|---|---|---|
| | Proportions of Additives (wt %) | 1 | 2 | 3 | 4 | 5 | 6 | 7 | 8 | 9 |
| A | Ca salicylate (70 TBN) | | | | | | | | | |
| | Ca salicylate (110 TBN) | | | 3.0 | | | | | | |
| | Ca salicylate (190 TBN) | 3.0 | 3.0 | | 3.0 | 3.0 | 3.0 | 3.0 | 3.0 | 3.0 |
| | Ca salicylate (330 TBN) | | | | | | | | | |
| B | Amine compound A - phenylnaphthylamine | 0.6 | 0.6 | 0.6 | 0.6 | | 0.6 | 0.6 | 0.6 | 0.6 |
| | Amine compound B - dialkyldiphenylamine | 0.2 | 0.2 . | 0.2 | 0.2 | 0.2 | 0.2 | 0.2 | 0.2 | 0.2 |
| C | Hindered phenol compound A | 0L6 | 0.6 | 0.6 | 0.6 | 0.6 | | 0.6 | 0.6 | 0.6 |
| | Hindered phenol compound B | 0.2 | 0.2 | 0.2 | 0.2 | 0.2 | 0.2 | 0.2 | 0.2 | 0.2 |
| D | Polyalkenylsuccinimide | 5.0 | | | | | | | | |
| | Boron-containing bis-type polyalkenylsuccinimide | 5.0 | 5.0 | 5.0 | 5.0 | 5.0 | 5.0 | 5.0 | 5.0 | 5.0 |
| E | Ca phenate (250 TBN) | | | | 1.0 | | | | 1.0 | 3.0 |
| | Wear inhibitor - zinc dialkyldithiophosphate | 1.5 | 1.5 | 1.5 | 1.5 | 1.5 | 1.5 | 1.5 | 1.5 | 1.5 |
| | Friction modifier - dialkylmolybdenum dithiocarbamate | 0.5 | 0.5 | 0.5 | 0.5 | 0.5 | 0.5 | 0.5 | 0.5 | 0.5 |
| | Viscosity index improver - ethylene-propylene copolymer | 5.5 | 5.5 | 5.5 | 5.5 | 5.5 | 5.5 | 5.5 | 5.5 | 5.5 |
| | Pour-point depressant - polymethacrylate | 0.1 | 0.1 | 0.1 | 0.1 | 0.1 | 0.1 | 0.1 | 0.1 | 0.1 |
| | Rust inhibitor - alkenylsuccinic acid | 0.2 | 0.2 | 0.2 | 0.2 | 0.2 | 0.2 | 0.2 | 0.2 | 0.2 |
| | Corrosion inhibitor - benzotriazole | 0.05 | 0.05 | 0.05 | 0.05 | 0.05 | 0.05 | 0.05 | 0.05 | 0.05 |
| | Foam inhibitor - dimethylpolysiloxane | 0.003 | 0.003 | 0.003 | 0.003 | 0.003 | 0.003 | 0.003 | 0.003 | 0.003 |
| | Total base number (mg-KOH/g) of lubricating oil composition | 5.7 | 5.7 | 3.3 | 8.2 | 5.7 | 5.7 | 13.3 | 15.8 | 15.1 |
| | Glass rod lacquer rating (color scale number) in an oxidation stability test for internal combustion engine lubricating oils | 2 | 2 | 2 | 1 | 3 | 3 | 2 | 1 | 1 |
| | Total acid number increase (mg-KOH/g) in an oxidation stability test for internal combustion engine lubricating oils | 3.1 | 2.5 | 2.6 | 1.9 | 3.4 | 2.8 | 2.4 | 1.6 | 1.6 |
| | Total acid number increase (mg-KOH/g) in a $NO_x$ oxidation test | 1.9 | 1.6 | 2.0 | 1.2 | I.8 | 1.7 | 1.7 | 1.0 | 1.1 |

NOTE:

Base oil: Hydro-refined oil (5.5 $mm^2/s$ at 100° C.)

Hindered phenol compound A: 4,4'-methylenebis(2,6-di-t-butylphenol)

Hindered phenol compound B: 2,2-thio[diethylbis-3(3,5-di-t-butyl-4-hydroxyphenol)propionate]

TABLE 2

| | | Comparative Examples | | | | | | | | | | | |
|---|---|---|---|---|---|---|---|---|---|---|---|---|---|
| | Proportions of Additives (wt %) | 1 | 2 | 3 | 4 | 5 | 6 | 7 | 8 | 9 | 10 | 11 | 12 |
| A | Ca salicilate (70 TBN) | | | | 3.0 | | | | | | | | |
| | Ca salicylate (110 TBN) | | | | | | | | 3.0 | | | | |
| | Ca salicylate (190 TBN) | 3.0 | 3.0 | 3.0 | | | | 3.0 | | 3.0 | 0.1 | 15 | |
| | Ca salicylate (330 TBN) | | | | | 3.0 | | | | | | | |
| | Ca salicylate (230 TBN) | | | | | | | | | | | | 3.0 |
| B | Amine compound A - phenylnaphthylamine | 0.6 | | 0.6 | 0.6 | 0.6 | 0.6 | 0.6 | 0.6 | 0.6 | 0.6 | 0.6 | 0.6 |
| | Amine compound B - dialkyldiphenylamine | 0.2 | | 0.2 | 0.2 | 0.2 | 0.2 | 0.2 | 0.2 | 0.2 | 0.2 | 0.2 | 0.2 |
| C | Hindered phenol compound A | 0.6 | 0.6 | | 0.6 | 0.6 | 0.6 | 0.6 | 0.6 | 0.6 | 0.6 | 0.6 | 0.6 |
| | Hindered phenol compound B | 0.2 | 0.2 | | 0.2 | 0.2 | 0.2 | 0.2 | 0.2 | 0.2 | 0.2 | 0.2 | 0.2 |
| D | Polyalkenylsuccinic acid | | | | | | | | | | | | |
| | Boron-containing bis-type polyalkenyl-succinimide | 0.5 | 5.0 | 5.0 | 5.0 | 5.0 | 5.0 | 5.0 | | 20.0 | 5.0 | 5.0 | 5.0 |
| E | Ca phenate (250 TBN) | | | | | | 1.0 | | | | | | |
| | Wear inhibitor - zinc dialkyldithiophosphate | 1.5 | 1.5 | 1.5 | 1.5 | 1.5 | 1.5 | | 1.5 | 1.5 | 1.5 | 1.5 | 1.5 |
| | Friction modifier - dialkylmolybdenum dithiocarbamate | 0.5 | 0.5 | 0.5 | 0.5 | 0.5 | 0.5 | 0.5 | 0.5 | 0.5 | 0.5 | 0.5 | 0.5 |
| | Viscosity index improver - ethylene-propylene copolymer | 5.5 | 5.5 | 5.5 | 5.5 | 5.5 | 5.5 | 5.5 | 5.5 | 5.5 | 5.5 | 5.5 | 5.5 |
| | Pour-point depressant - polymethacrylate | 0.1 | 0.1 | 0.1 | 0.1 | 0.1 | 0.1 | 0.1 | 0.1 | 0.1 | 0.1 | 0.1 | 0.1 |
| | Rust inhibitor - alkenylsuccinic acid | 0.2 | 0.2 | 0.2 | 0.2 | 0.2 | 0.2 | 0.2 | 0.2 | 0.2 | 0.2 | 0.2 | 0.2 |
| | Corrosion inhibitor - benzotriazole | 0.05 | 0.05 | 0.05 | 0.05 | 0.05 | 0.05 | 0.05 | 0.05 | 0.05 | 0.05 | 0.05 | 0.05 |
| | Foam inhibitor - dimethylpolysiloxane | 0.003 | 0.003 | 0.003 | 0.003 | 0.003 | 0.003 | 0.003 | 0.003 | 0.003 | 0.003 | 0.003 | 0.003 |
| | Total base number (mg-KOH/g) of lubricating oil composition | 5.7 | 5.7 | 5.7 | 2.1 | 9.9 | 2.5 | 5.7 | 3.3 | 5.7 | 0.2 | 28.5 | 6.9 |
| | Glass rod lacquer rating (color scale number) in an oxidation stability test for internal combustion engine lubricating oils | 5 | 6 | 5 | 4 | 5 | 5 | 6 | 5 | 4 | 5 | 4 | 4 |
| | Total acid number increase (mg-KOH/g) in an oxidation stability test for internal combustion engine lubricating oils | 4.1 | 5.5 | 4.3 | 4.0 | 3.9 | 4.2 | 5.6 | 4.3 | 4.5 | 4.7 | 3.8 | 3.9 |

TABLE 2-continued

| Proportions of Additives (wt %) | Comparative Examples | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Total acid number increase (mg-KOH/g) in a $NO_x$ oxidation test | 3.2 | 3.6 | 4.0 | 2.9 | 3.1 | 3.3 | 4.2 | 3.5 | 3.3 | 3.7 | 2.7 | 2.9 |

NOTE:
Base oil: Hydro-refined oil (5.5 $mm^2/s$ at 100° C.)
Hindered phenol compound A: 4,4'-methylenebis(2,6-di-t-butylphenol)
Hindered phenol compound B: 2,2-thio[diethylbis-3(3,5-di-t-butyl-4-hydroxyphenol)propionate]

As is apparent from the above description, the adoption of the specific combination of the metal salicylate, the oxidation inhibitors comprising the amine compound and the hindered phenol compound, and the polyalkenylsuccinimide combined with the lubricating base oil can provide a GHP engine oil excellent in all the properties of glass rod lacquer rating and total acid number increase in an oxidation test for internal combustion engine lubricating oils even under severe conditions of high-temperature combustion and in the properties of detergency, $NO_x$ oxidation resistance and thermal oxidation resistance as indicated by a reduced increase in total acid number after a $NO_x$ oxidation test.

What is claimed is:

1. A method for improving the detergency, $NO_x$ oxidation resistance and thermal oxidation resistance of a long life gas engine lubricating oil composition comprising adding to a lubricating oil base stock an additive mixture comprising:

(A) 0.5 wt % to 10 wt % of a metal salicylate having a total base number (TBN) of from 100 mg-KOH/g to 195 mg-KOH/g;

(B) 0.1 wt % to 10 wt % of at least one oxidation inhibitor selected from the group consisting of amine compounds;

(C) 0.1 wt % to 10 wt % of at least one oxidation inhibitor selected from the group consisting of hindered phenol compounds;

(D) 1 wt % to 10 wt % of a polyalkenylsuccinimide and/or a boron-containing polyalkenylsuccinimide; and (F) 0.05 wt % to 5.0 wt % of zinc dialkyldithiophosphate.

2. The method of claim 1, further comprising the additional use of (E) 0.1 wt % to 10 wt % of a metal phenate having a total base number of from 100 mg-KOH/g to 300 mg-KOH/g.

3. The method of claim 1 further comprising controlling the total base number of the lubricating oil composition to be in the range of from 1 mg-KOH/g to 20 mg-KOH/g.

4. The method of claim 2 further comprising controlling the total base number of the lubricating oil composition to be in the range of from 1 mg-KOH/g to 20 mg-KOH/g.

5. The method of claim 1, 2, 3 or 4 wherein the metal salicylate is an alkaline earth metal salicylate, the amine oxidation inhibitor is composed of a dialkyldiphenyl amine and a phenyl-α-naphthylamine; the phenol oxidation inhibitor is composed of 2,2-thio(diethyl bis-3(3,5-di-t-butyl-4-hydroxyphenol)propionate) and 4,4'-methylenebis (2,6-di-t-butyl-phenol) and the succinimide is a boron-containing polyalkenylsuccinimide.

6. The method of claim 1, 2, 3 or 4 wherein the metal salicylate is present in an amount in the range 1 wt % to 8 wt %, the amine type oxidation inhibitor is present in an amount in the range 0.3 wt % to 3 wt %, the phenol oxidation inhibitor is present in an amount in the range 0.3 wt % to 4 wt % and the polyalkenylsuccinimide and/or boron-containing polyalkenylsuccinimide is present in an amount in the range 4 wt % to 8 wt %.

7. The method of claim 2 or 4 wherein the metal phenate is present in an amount in the range 0.3 wt % to 5 wt %.

8. The method of claim 1, 2, 3 or 4 wherein the amine oxidation inhibitor and the phenol oxidation inhibitor are present in a ratio of 9:1 to 1:9.

* * * * *